US010995985B2

(12) United States Patent
Tai et al.

(10) Patent No.: US 10,995,985 B2
(45) Date of Patent: May 4, 2021

(54) DRYING APPARATUS AND DRYING METHOD

(71) Applicant: Industrial Technology Research Institute, Hsinchu (TW)

(72) Inventors: Chin-Chih Tai, Zhudong Township, Hsinchu County (TW); Yi-Shan Lee, Taipei (TW); Yun-Hsin Wang, Kaohsiung (TW); Cheng-Fu Hsu, Qionglin Township, Hsinchu County (TW)

(73) Assignee: INDUSTRIAL TECHNOLOGY RESEARCH INSTITUTE, Hsinchu (TW)

( * ) Notice: Subject to any disclaimer, the term of this patent is extended or adjusted under 35 U.S.C. 154(b) by 821 days.

(21) Appl. No.: 15/099,208

(22) Filed: Apr. 14, 2016

(65) Prior Publication Data

US 2017/0167789 A1 Jun. 15, 2017

(30) Foreign Application Priority Data

Dec. 9, 2015 (TW) ..... 104141288

(51) Int. Cl.
*F26B 3/04* (2006.01)
*F26B 21/10* (2006.01)
*F26B 21/08* (2006.01)

(52) U.S. Cl.
CPC ..... *F26B 3/04* (2013.01); *F26B 21/08* (2013.01); *F26B 21/083* (2013.01); *F26B 21/10* (2013.01)

(58) Field of Classification Search
CPC ..... F26B 3/04; F26B 21/083; F26B 21/08; F26B 21/10; B01D 53/261; B01D 53/263; B01D 63/00; B01D 63/02; B01D 63/022
(Continued)

(56) References Cited

U.S. PATENT DOCUMENTS 3,188,283 A * 6/1965 Cole ..... F26B 21/083 205/628
4,900,448 A 2/1990 Bonne et al.
(Continued)

FOREIGN PATENT DOCUMENTS

CN 102989258 A 3/2013
CN 103025410 A 4/2013
(Continued)

OTHER PUBLICATIONS

H.H. Nijhuis, et al., "Approaches to improving the quality of dried fruit and vegetables", Trends in Food Science & Technology, vol. 9, 1998, pp. 13-20.
(Continued)

*Primary Examiner* — Edelmira Bosques
*Assistant Examiner* — Bao D Nguyen
(74) *Attorney, Agent, or Firm* — Muncy, Geissler, Olds and Lowe, P.C.

(57) ABSTRACT

A drying apparatus includes a gas flow channel, a first hollow fiber module, a second hollow fiber module, a gas driver and a control unit. The gas flow channel is used to accommodate an article and has a first terminal and a second terminal. The first and second hollow fiber modules are disposed at the first and second terminals respectively to adsorb water or to be electrified to desorb water. The gas driver disposed in a gas flow path of the gas flow channel drives the gas flowing into the gas flow channel through the first hollow fiber module and flowing out from the gas flow channel through the second hollow fiber module, or flowing into the gas flow channel through the second hollow fiber module and flowing out from the gas flow channel through the first hollow fiber module. The control unit provides power to the first and second hollow fiber modules and controls the gas driver.

9 Claims, 3 Drawing Sheets

(58) Field of Classification Search
USPC ..... 34/474; 95/52; 210/321.88, 321.89, 210/500.23
See application file for complete search history.

(56) References Cited

U.S. PATENT DOCUMENTS

| | | | | |
|---|---|---|---|---|
| 2002/0121028 | A1* | 9/2002 | Nardi | F26B 21/02 34/201 |
| 2006/0065117 | A1 | 3/2006 | Jain | |
| 2010/0035751 | A1 | 2/2010 | Perera et al. | |
| 2010/0050666 | A1* | 3/2010 | Meyer | B01D 53/261 62/94 |
| 2014/0150287 | A1 | 6/2014 | Ahn et al. | |
| 2014/0166571 | A1* | 6/2014 | Tai | B01D 69/082 210/500.23 |

FOREIGN PATENT DOCUMENTS

| | | | |
|---|---|---|---|
| CN | 103079674 | A | 5/2013 |
| CN | 104083997 | A | 10/2014 |
| CN | 104645791 | A | 5/2015 |
| JP | H04203885 | A | 7/1992 |
| JP | 2009183912 | A | 8/2009 |
| JP | 2013059760 | A | 4/2013 |
| JP | 2015158288 | A | 9/2015 |
| TW | 195138 | | 11/1992 |
| TW | 312906 | U | 8/1997 |
| TW | I430885 | B | 3/2014 |
| TW | 201424826 | A | 7/2014 |

OTHER PUBLICATIONS

Piotr P. Lewicki, "Design of hot air drying for better foods", Trends in Food Science & Technology, vol. 17, 2006, pp. 153-163.

Marjan Javanmard, et al., "Development of a Semi-Industrial Multi Fruit Dryer System Using Simultaneous Intelligent Control", American Journal of Applied Sciences, vol. 7, No. 2, 2010, pp. 160-166.

Piotr P. Lewicki, et al., "Effect of hot air temperature on mechanical properties of dried apples", Journal of Food Engineering, vol. 64, 2004, pp. 307-314.

K.J. Chua, et al., "Low-cost drying methods for developing countries", Trends in Food Science & Technology, vol. 14, 2003, pp. 519-528.

Chnese Intellectual Property Office, Office Action, dated Dec. 4, 2018, 6 pages.

* cited by examiner

DRYING APPARATUS AND DRYING METHOD

CROSS-REFERENCE TO RELATED APPLICATION

This application claims the priority benefit of Taiwan application serial no. 104141288, filed on Dec. 9, 2015. The entirety of the above-mentioned patent application is hereby incorporated by reference herein and made a part of specification.

TECHNICAL FIELD

The disclosure relates to a drying apparatus and a drying method for removing water contained in an article.

BACKGROUND

Because the shelf life of food tends to be extended and the flavor of food is improved after drying, food drying technology is becoming very important in food processing. Food drying technology is divided into many categories, such as dry roasting, freeze-drying, low-temperature drying, etc. Other than food drying, drying technology may also be applied for drying clothes and medical material. When drying technology is applied for drying clothes, the moisture content of clothes is reduced to keep clothes dry and to prevent clothes from becoming moldy and stinky. When drying technology is applied for drying medical material, the moisture content of medical material is reduced so that bacterial growth is decreased.

SUMMARY

A drying apparatus of the disclosure includes a gas flow channel, a first hollow fiber module, a second hollow fiber module, at least one gas driver and a control unit. The gas flow channel is used to accommodate an article and has a first terminal and a second terminal. The first hollow fiber module is disposed at the first terminal to adsorb water or to be electrified to desorb water. The second hollow fiber module is disposed at the second terminal to adsorb water or to be electrified to desorb water. The at least one gas driver is disposed in a gas flow path of the gas flow channel to drive the gas flowing into the gas flow channel through the first hollow fiber module and flowing out from the gas flow channel through the second hollow fiber module, or flowing into the gas flow channel through the second hollow fiber module and flowing out from the gas flow channel through the first hollow fiber module. The control unit is electrically coupled to the first hollow fiber module, the second hollow fiber module, and the at least one gas driver, so as to provide power to the first hollow fiber module, to provide power to the second hollow fiber module, and to control the at least one gas driver.

A drying method of the disclosure is adapted to remove water that is contained in an article accommodated inside a gas flow channel, a first hollow fiber module is disposed at a first terminal of the gas flow channel, a second hollow fiber module is disposed at a second terminal of the gas flow channel, at least one gas driver is disposed in a gas flow path of the gas flow channel, the first hollow fiber module, the second hollow fiber module, and the at least one gas driver are electrically coupled to a control unit. The drying method includes steps as follows. The control unit controls the at least one gas driver to drive a gas to flow into the gas flow channel through the first hollow fiber module such that the first hollow fiber module adsorbs water contained in the gas flowing into the gas flow channel After the control unit controls the at least one gas driver to drive the gas to flow into the gas flow channel through the first hollow fiber module, the control unit controls the at least one gas driver to drive a gas to flow into the gas flow channel through the second hollow fiber module such that the second hollow fiber module adsorbs water contained in the gas flowing into the gas flow channel.

A drying method of the disclosure is adapted to remove water that is contained in an article accommodated inside a gas flow channel, a first hollow fiber module is disposed at a first terminal of the gas flow channel, a second hollow fiber module is disposed at a second terminal of the gas flow channel, at least one gas driver is disposed in a gas flow path of the gas flow channel, the first hollow fiber module, the second hollow fiber module, and the at least one gas driver are electrically coupled to a control unit. The drying method includes steps as follows. The control unit controls the at least one gas driver to drive a gas to flow into the gas flow channel through the first hollow fiber module, and the first hollow fiber module adsorbs water contained in the gas flowing into the gas flow channel. During the control unit controls the at least one gas driver to drive the gas to flow into the gas flow channel through the first hollow fiber module, the control unit provides power to the second hollow fiber module to desorb water contained in the second hollow fiber module.

In order to make the aforementioned and other features and advantages of the invention more comprehensible, embodiments accompanying figures are described in detail bellows.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1:
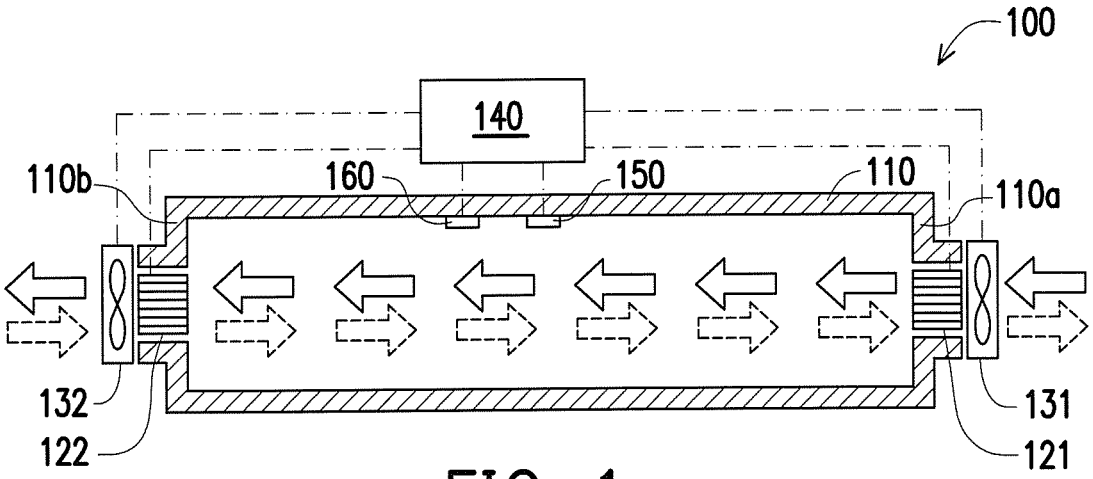
FIG. 1 is a schematic view of a drying apparatus according to one embodiment of the disclosure.

Referring to FIG. 1, in the present embodiment, a drying apparatus 100 is adapted to remove water contained in an article. The article can be food, clothes, and medical equipment, for example. The drying apparatus 100 includes a gas flow channel 110, a first hollow fiber module 121, a second hollow fiber module 122, a first gas driver 131 (such as a fan), a second gas driver 132 (such as a fan), and a control unit 140. The gas flow channel 110 is used to accommodate an article. The article may be accommodated inside the gas flow channel 110 via supporting dish, supporting net, hanging hook, etc., but the gas flow inside the gas flow channel 110 is not blocked.

The first hollow fiber module 121 and the second hollow fiber module 122 have conductive function and adsorption function. To be more specific, the first hollow fiber module 121 is formed by at least one hollow fiber 121*a*, and the second follow fiber module 122 is formed by at least one hollow fiber 122*a*. The hollow fiber 121*a*, 122*a* has at least one hollow channel 121*a*1, 122*a*1 for the gas passing through. The hollow fiber 121*a*, 122*a* includes at least one adsorption material 121*a*2, 122*a*2 and at least one conductive material 121*a*3, 122*a*3. The adsorption material 121*a*2, 122*a*2 may adsorb water contained in the gas, and may even adsorb volatile organic compounds contained in the gas (hereinafter referred to as VOCs). Electric power is provided to the conductive material 121*a*3, 122*a*3 for heating the adsorption material 121*a*2, 122*a*2, so as to desorb water that is contained therein, and even to desorb VOCs. When the conductive material 121*a*3, 122*a*3 is silver, it may also provide sterilization function.

It should be noted here, the composition and manufacturing method of the hollow fiber having conductivity and adsorption functions may refer to US patent publication number US20100035751 and US20140166571. Therefore, in the present embodiment, only configured location and operating method of the first hollow fiber module 121 and the second hollow fiber module 122 are described, and structure and manufacturing method of the first hollow fiber module 121 and the second hollow fiber module 122 are not repeated.

Referring to FIG. 1, the gas flow channel 110 has a first terminal 110*a* and a second terminal 110*b* to serve as gates or ports for gases passing through. The first hollow fiber module 121 is disposed at the first terminal 110*a* of the gas flow channel 110 to adsorb water or to be electrified to desorb water. The first hollow fiber module 121 is disposed "at" the first terminal 110*a* also means that the first hollow fiber module 121 may be disposed "adjacent to", "close to" or "nearby" the first terminal 110*a*. The second hollow fiber module 122 is disposed at the second terminal 110*b* of the gas flow channel 110 to adsorb water or to be electrified to desorb water. The second hollow fiber module 122 is disposed "at" the second terminal 110*b* also means that the second hollow fiber module 122 may be disposed "adjacent to", "close to" or "nearby" the second terminal 110*b*. The first gas driver 131 is disposed in the gas flow path of the gas flow channel 110 to drive the gas flowing into the gas flow channel 110 through the first hollow fiber module 121 and flowing out from the gas flow channel 110 through the second hollow fiber module 122. The second gas driver 132 is disposed in the gas flow path of the gas flow channel 110 to drive the gas flowing into the gas flow channel 110 through the second hollow fiber module 122 and flowing out from the gas flow channel 110 through the first hollow fiber module 121. The control unit 140 is electrically coupled to the first hollow fiber module 121, the second hollow fiber module 122, the first gas driver 131, and the second gas driver 132, so as to provide power to the first hollow fiber module 121, to provide power to the second hollow fiber module 122, and to control the first gas driver 131 and the second gas driver 132. The control unit 140 may include a motherboard and a required human machine interface, such as power switch or control panel.

Therefore, the control unit 140 may provide power to the first hollow fiber module 121 and the second hollow fiber module 122 to heat the first hollow fiber module 121 and the second hollow fiber module 122, so as to desorb the contained water. In addition, the control unit 140 may control the first gas driver 131 to drive the gas to flow from the first terminal 110*a* toward the second terminal 110*b*, or may control the second gas driver 132 to drive the gas to flow from the second terminal 110*b* toward the first terminal 110*a*. Therefore, when the adsorption function of the first hollow fiber module 121 is executed, the first gas driver 131 may drive the gas to flow from the first terminal 110*a* toward the second terminal 110*b*. Therefore, when the adsorption function of the second hollow fiber module 122 is executed, the second gas driver 132 may drive the gas to flow from the second terminal 110*b* toward the first terminal 110*a*. In addition, when the adsorption function of the first hollow fiber module 121 is executed, the second hollow fiber module 122 may be electrified to execute desorption function. When the adsorption function of the second hollow fiber module 122 is executed, the first hollow fiber module 121 may be electrically heated to execute desorption function. It should be noted here, after the first hollow fiber module 121 or the second hollow fiber module 122 is electrically heated to execute desorption function completely, the residual heat of the first hollow fiber module 121 or the second hollow fiber module 122 may also be carried back to inside the gas flow channel 110 by the gas flow, to assist evaporation rate of water, therefore, to save drying time.

Referring to FIG. 1, in order to drive the gas more efficiently, in the present embodiment, the first gas driver 131 is disposed adjacent to the first hollow fiber module 121, so as to drive the gas flowing into or out from the gas flow channel 110 through the first hollow fiber module 121. In addition, the second gas driver 132 is disposed adjacent to the second hollow fiber module 122, so as to drive the gas flowing into or out from the gas flow channel 110 through the second hollow fiber module 122. Under normal circumstances, the first gas driver 131 and the second gas driver 132 may simultaneously or alternately drive the gas to flow from the first terminal 110*a* toward the second terminal 110*b*, or drive the gas to flow from the second terminal 110*b* toward the first terminal 110*a*. Therefore, the number of gas drivers is not restricted and may be one or more, it means there is at least one gas driver, two gas drivers are described in the present embodiment as an example, namely, the first gas driver 131 and the second gas driver 132. Otherwise, under special circumstances and at the same time, the gas drivers (including the first gas driver 131 and the second gas driver 132) may also drive the gas to flow into the gas flow channel 110 through a plurality of hollow fiber modules (including the first hollow fiber module 121 and the second hollow fiber module 122) respectively, so that the gas flows through a check valve (not shown) disposed on the gas flow channel 110.

Referring to FIG. 1, except that the low vapor pressure is used to remove water contained in the article, in the present embodiment, roasting method may also be additionally provided to remove water contained in the article, that is to say, the control unit 140 controls the first gas driver 131 and the second gas driver 132 to drive the gas through the first hollow fiber module 121 and the second hollow fiber module 122 respectively, and the control unit 140 simultaneously provides power to the first hollow fiber module 121 and the second hollow fiber module 122 to heat the gas flowing through the first hollow fiber module 121 and the second hollow fiber module 122 into the gas flow channel 110, so that the heated gas flow heats the article to remove water contained in the article.

Referring to FIG. 1, in order to control whether the first hollow fiber module 121 and the second hollow fiber module 122 are electrified to perform desorption, whether the first gas driver 131 and the second gas driver 132 are operated, and the flowing direction of the first gas driver 131 and the second gas driver 132 according to temperature and humidity inside the gas flow channel 110, the drying apparatus 100 further includes a temperature sensor 150 and a humidity sensor 160. The temperature sensor 150 is disposed inside the gas flow channel 110 and electrically coupled to the control unit 140 for sensing the temperature inside the gas flow channel 110. The humidity sensor 160 is disposed inside the gas flow channel 110 and electrically coupled to the control unit 140 for sensing the humidity inside the gas flow channel 110. Therefore, the control unit 140 may determine whether to provide power to the first hollow fiber module 121 and the second hollow fiber module 122, determine whether to drive the first gas driver 131 and the second gas driver 132, and determine the flowing direction of the first gas driver 131 and the second gas driver 132 according to the real-time temperature and humidity.

Referring to FIG. 1, in the present embodiment, the gas flow channel 110 of the drying apparatus 100 may disposed vertically as the direction of gravity, but may also be disposed horizontally with respect to the direction of gravity.

Figure 2:
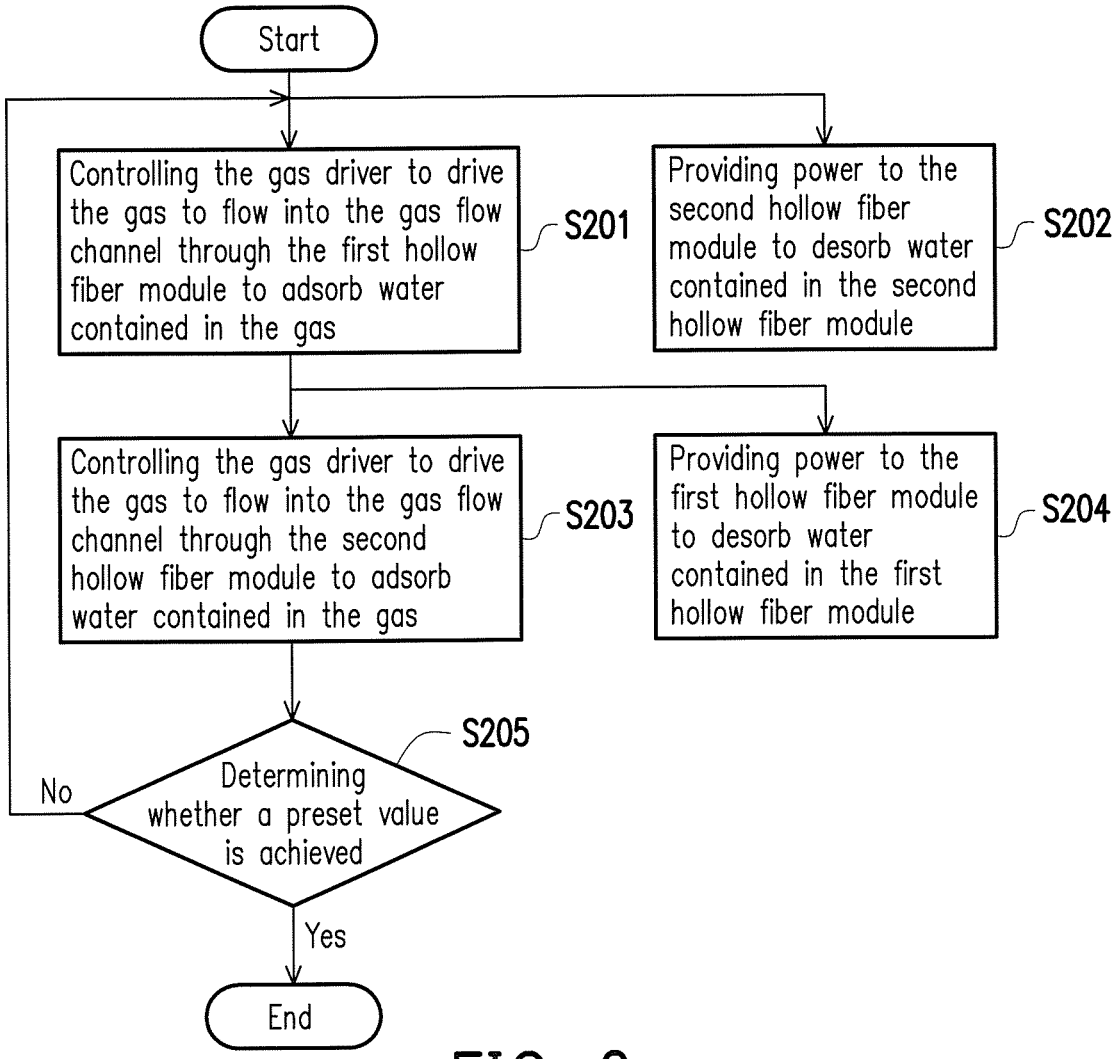
FIG. 2 is a flow chart of a drying method according to one embodiment of the disclosure.
Figure 1B:
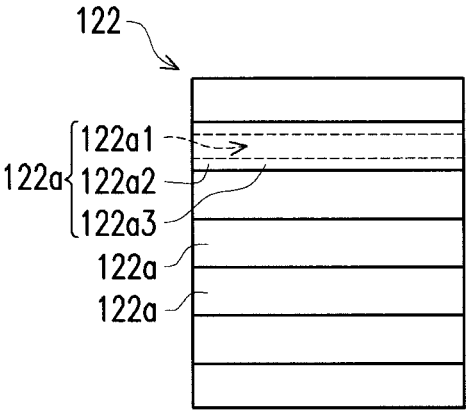
FIG. 1B is another partial enlarged view of FIG. 1, illustrating a second hollow fiber module of the drying apparatus.
Figure 1A:
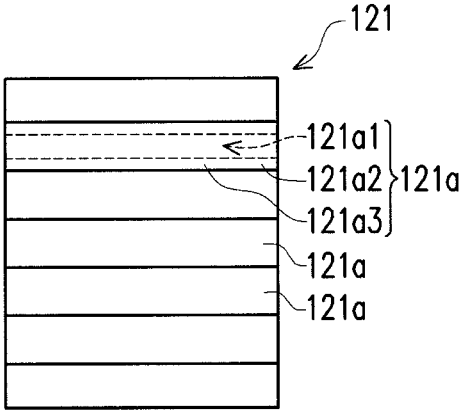
FIG. 1A is a partial enlarged view of FIG. 1, illustrating a first hollow fiber module of the drying apparatus.

Referring to FIGS. 1 and 2, wherein FIG. 2 is a flow chart of a drying method according to one embodiment of the disclosure for actualizing how to control the drying apparatus 100 in FIG. 1 to remove water contained in the article. In the present embodiment, as depicted in step S201, the control unit 140 controls the gas driver (such as the first gas driver 131, the second gas driver 132, or both gas drivers at the same time) to drive the gas to flow into the gas flow channel 110 through the first hollow fiber module 121 continuously for an adsorption time, and the first hollow fiber module 121 adsorbs water contained in the gas flowing into the gas flow channel 110.

During the execution of step S201, that is, during the control unit 140 controls the gas driver (such as the first gas driver 131, the second gas driver 132, or both gas drivers at the same time) to drive the gas, step S202 may also be executed at the same time, the control unit 140 provides power to the second hollow fiber module 122 continuously for a desorption time to desorb water contained in the second hollow fiber module 122. In one embodiment, adsorption time of the first hollow fiber module 121 is, for example, thirty minutes, and desorption time of the second hollow fiber module 122 is, for instance, fifteen minutes, therefore, desorption time of the second hollow fiber module 122 is less than adsorption time of the first hollow fiber module 121. However, the disclosure is not limited thereto.

Subsequently, as depicted in step S203, the control unit 140 controls the gas driver (such as the first gas driver 131, the second gas driver 132, or both gas drivers at the same time) to drive the gas to flow into the gas flow channel 110 through the second hollow fiber module 122 continuously for an adsorption time, and the second hollow fiber module 122 adsorbs water contained in the gas flowing into the gas flow channel 110.

During the execution of step S203, that is, during the control unit 140 controls the gas driver (such as the first gas driver 131, the second gas driver 132, or both gas drivers at the same time) to drive the gas, step S204 may also be executed at the same time, the control unit 140 provides power to the first hollow fiber module 121 continuously for a desorption time to desorb water contained in the first hollow fiber module 121. In one embodiment, adsorption time of the second hollow fiber module 122 is, for example, thirty minutes, and desorption time of the first hollow fiber module 121 is, for instance, fifteen minutes, therefore, desorption time of the first hollow fiber module 121 is less than adsorption time of the second hollow fiber module 122. However, the disclosure is not limited thereto.

Subsequently, as depicted in S205, the control unit 140 determines whether a preset value is achieved, the preset value may be a preset number of cycles of executing steps S201 and S203, a preset value of humidity, or a preset drying time. When the preset value is not achieved, steps 201 and 203 that the first hollow fiber module 121 and the second hollow fiber module 122 adsorb water are alternately executed until the preset value is achieved. When the preset value is achieved, drying operation is stopped, and steps 201 and 203 that the first hollow fiber module 121 and the second hollow fiber module 122 adsorb water are stopped to be alternately executed.

Figure 3:
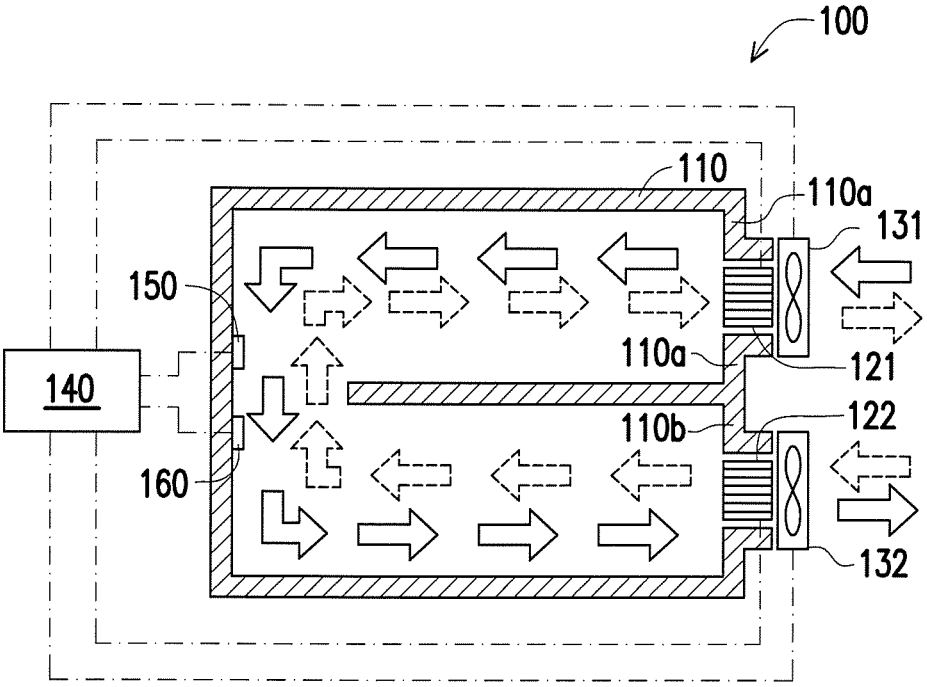
FIG. 3 is a schematic view of a drying apparatus according to another embodiment of the disclosure.

Referring to FIG. 3, compared to the drying apparatus 100 adopting the I-shaped gas flow channel 110 in the embodiment in FIG. 1, in order to increase the length of the gas flow channel 110 or to save the space occupied by the drying apparatus 100, the drying apparatus 100 of the embodiment in FIG. 3 adopts a curved gas flow channel 110, such as U-shaped gas flow channel 110, but the disclosure is not limited thereto. The S-shaped or W-shaped gas flow channel 110 may also be adopted.

Figure 4:
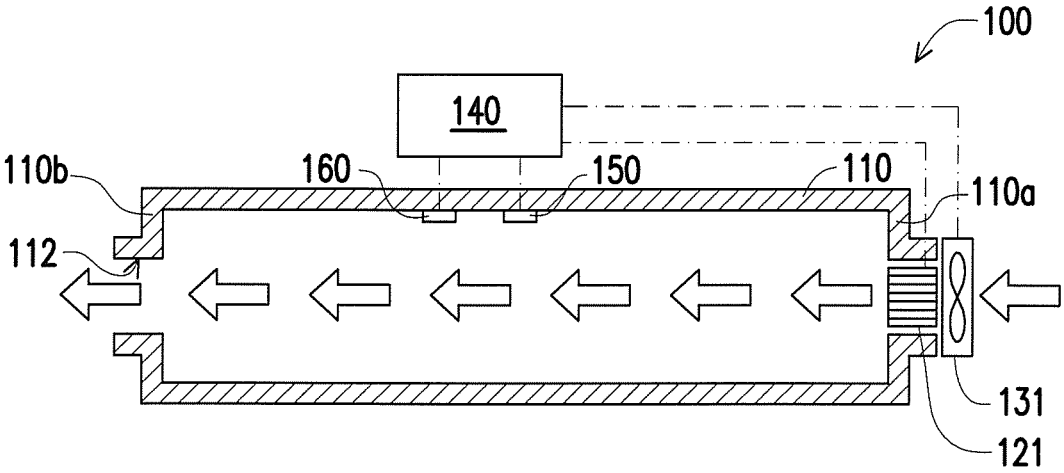
FIG. 4 is a schematic view of a drying apparatus according to another embodiment of the disclosure.

Referring to FIG. 4, compared to the drying apparatus 100 of the embodiment in FIG. 1, the drying apparatus 100 of the embodiment in FIG. 4 merely uses one first hollow fiber module 121 and one first gas driver 131 at the first terminal 110*a* of the gas flow channel 110, and the first hollow fiber module 121 merely has heating function. Therefore, the control unit 140 provides power to the first hollow fiber module 121 to perform heating, and the control unit 140 control the first gas driver 131 to drive the gas to flow through the first hollow fiber module 121 and into the gas flow channel 110 after being heated by the first hollow fiber module 121. After the heated gas flow flows through the article, the heated gas flow may flow out from the gas flow channel 110 through an opening 112 of the second terminal 110*b* of the gas flow channel 110.

In summary, in this disclosure, the gas driver drives the gas through hollow fiber modules to adsorb water contained in the gas, so as to provide dry gas into the gas flow channel. Therefore, dry gas is supplied to remove water contained in the article. In this disclosure, two or more hollow fiber modules are provided, when one of the hollow fiber modules performs adsorption, another hollow fiber module may be electrically heated to desorb water contained therein. Therefore, when one hollow fiber module is switched to be operated, the original adsorption ability of another hollow fiber module may be restored. Two or more hollow fiber modules alternately operate adsorption and desorption to increase speed for drying the article. The hollow fiber module may use heating function independently and may be combined with the gas driver to generate the heated gas flow flowing into the gas flow channel, so as to execute roasting function.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A drying apparatus, comprising:

a gas flow channel, used to accommodate an article and having a first terminal and a second terminal;

a first hollow fiber module, disposed inside the first terminal of the gas flow channel to adsorb water or to be electrified to desorb water;

a second hollow fiber module, disposed inside the second terminal of the gas flow channel to adsorb water or to be electrified to desorb water;

at least one gas driver, disposed in a gas flow path of the gas flow channel to drive a gas in a period of time flowing into the gas flow channel through the first hollow fiber module and flowing out from the gas flow channel through the second hollow fiber module, and in another period of time flowing into the gas flow channel through the second hollow fiber module and flowing out from the gas flow channel through the first hollow fiber module; and a control unit, electrically coupled to the first hollow fiber module, the second hollow fiber module, and the at least one gas driver, so as to provide power to the first hollow fiber module, to provide power to the second hollow fiber module, and to control the at least one gas driver, wherein the first hollow fiber module or the second follow fiber module is formed by at least one hollow fiber, the at least one hollow fiber has at least one hollow channel, the at least one hollow fiber comprises at least one adsorption material and at least one conductive material, and the conductive material is mixed with the absorption material, wherein a desorption time that the control unit provides power to the first hollow fiber module is less than an adsorption time that the at least one gas driver drives the gas flowing into the gas flow channel through the second hollow fiber module.

2. The drying apparatus as recited in claim 1, wherein the at least one gas driver is disposed adjacent to the first hollow fiber module or the second follow fiber module.

3. The drying apparatus as recited in claim 1, wherein the at least one gas driver comprises:

a first gas driver, disposed adjacent to the first hollow fiber module and electrically coupled to the control unit, so as to drive the gas flowing into or out from the gas flow channel through the first hollow fiber module; and a second gas driver, disposed adjacent to the second hollow fiber module and electrically coupled to the control unit, so as to drive the gas flowing into or out from the gas flow channel through the second hollow fiber module.

4. The drying apparatus as recited in claim 1, further comprising:

a temperature sensor, disposed inside the gas flow channel and electrically coupled to the control unit.

5. The drying apparatus as recited in claim 1, further comprising:

a humidity sensor, disposed inside the gas flow channel and electrically coupled to the control unit.

6. The drying apparatus as recited in claim 1, wherein the gas flow channel is an I-shaped, U-shaped, T-shaped or W-shaped channel.

7. A drying method, adapted to remove water contained in an article accommodated inside a gas flow channel, a first hollow fiber module being disposed inside a first terminal of the gas flow channel, a second hollow fiber module being disposed inside a second terminal of the gas flow channel, at least one gas driver being disposed in a gas flow path of the gas flow channel, the first hollow fiber module, the second hollow fiber module, and the at least one gas driver being electrically coupled to a control unit, the drying method comprising:

controlling the at least one gas driver via the control unit to drive a gas to flow into the gas flow channel through the first hollow fiber module such that the first hollow fiber module adsorbs water contained in the gas as the gas flows into the gas flow channel from an external of the gas flow channel, wherein the first hollow fiber module or the second follow fiber module is formed by at least one hollow fiber, the at least one hollow fiber has at least one hollow channel, the at least one hollow fiber comprises at least one adsorption material and at least one conductive material, and the conductive material is mixed with the absorption material;

after the control unit controls the at least one gas driver to drive the gas to flow into the gas flow channel through the first hollow fiber module, controlling the at least one gas driver via the control unit to drive a gas to flow into the gas flow channel through the second hollow fiber module such that the second hollow fiber module adsorbs water contained in the gas as the gas flows into the gas flow channel from the external of the gas flow channel; and providing power to the first hollow fiber module by the control unit to desorb water contained in the first hollow fiber module during the control unit controls the at least one gas driver to drive the gas to flow into the gas flow channel through the second hollow fiber module, wherein a desorption time that the control unit provides power to the first hollow fiber module is less than an adsorption time that the at least one gas driver drives the gas flowing into the gas flow channel through the second hollow fiber module.

8. The drying method as recited in claim 7, further comprising:

determining whether a preset value is achieved by the control unit, when the preset value is not achieved, steps that the first hollow fiber module and the second hollow fiber module adsorb water are alternately executed, when the preset value is achieved, steps that the first hollow fiber module and the second hollow fiber module adsorb water are stopped to be alternately executed.

9. The drying method as recited in claim 8, wherein the preset value is a preset number of cycles of steps that the first hollow fiber module and the second hollow fiber module adsorb water are alternately executed, a preset value of humidity, or a preset drying time.

* * * * *